US009857084B2

(12) United States Patent
Hildner et al.

(10) Patent No.: US 9,857,084 B2
(45) Date of Patent: Jan. 2, 2018

(54) EXHAUST CLOSURE SYSTEM FOR A COOKING OVEN

(71) Applicant: Electrolux Home Products Corporation N. V., Brussels (BE)

(72) Inventors: Dietmar Hildner, Rothenburg ob der Tauber (DE); Erhard Kaser, Rothenburg ob der Tauber (DE); Branko Ivanovic, Rothenburg ob der Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 54 days.

(21) Appl. No.: 14/417,881

(22) PCT Filed: Sep. 16, 2013

(86) PCT No.: PCT/EP2013/069081
§ 371 (c)(1),
(2) Date: Jan. 28, 2015

(87) PCT Pub. No.: WO2014/048775
PCT Pub. Date: Apr. 3, 2014

(65) Prior Publication Data

US 2015/0211747 A1 Jul. 30, 2015

(30) Foreign Application Priority Data

Sep. 28, 2012 (EP) ..... 12186502

(51) Int. Cl.
*F24C 15/20* (2006.01)

(52) U.S. Cl.
CPC ..... *F24C 15/2007* (2013.01)

(58) Field of Classification Search
USPC ..... 126/21 A, 21 R, 312
See application file for complete search history.

(56) References Cited

U.S. PATENT DOCUMENTS 1,678,730 A 7/1928 Johnson
3,051,158 A * 8/1962 Kimberley ..... F24C 15/2007 126/21 A (Continued)

FOREIGN PATENT DOCUMENTS

EP 0413501 2/1991
EP 1426694 6/2004

(Continued)

OTHER PUBLICATIONS

International Search Report for PCT/EP2013/069081, dated Oct. 28, 2013, 3 pages.

*Primary Examiner* — Avinash Savani
(74) *Attorney, Agent, or Firm* — Pearn & Gordon LLP

(57) ABSTRACT

The present invention relates to an exhaust closure system for a cooking oven with a vertical vapour pipe (10) in an upper portion of the oven cavity. The exhaust closure system comprises an elongated slider (12) movable along its longitudinal axis. The slider (12) is provided for a horizontal arrangement within the plane above the vapour pipe (10). The exhaust closure system comprises an cover element (12; 22) for covering the vapour pipe (10). The exhaust closure system comprises a driving device (16) for moving the slider (12). The cover element (12; 22) is a horizontal sheet element and moveable within a horizontal plane for opening and closing the vapour pipe (10). Further, the present invention relates to a cooking oven comprising an exhaust closure system.

14 Claims, 5 Drawing Sheets

(56) References Cited

U.S. PATENT DOCUMENTS

| | | | | | |
|---|---|---|---|---|---|
| 3,196,862 | A | | 7/1965 | Jenn et al. | |
| 3,624,742 | A | * | 11/1971 | Hurko | F24C 15/2007 126/21 R |
| 4,114,589 | A | * | 9/1978 | Berlik | F24C 15/2007 126/21 R |
| 5,500,508 | A | | 3/1996 | Gerl | |
| 5,711,209 | A | * | 1/1998 | Guines | F24B 1/207 126/25 R |
| 7,644,711 | B2 | * | 1/2010 | Creel | F24B 1/192 126/21 R |
| 2013/0025582 | A1 | * | 1/2013 | Cadima | F24C 3/128 126/289 |

FOREIGN PATENT DOCUMENTS

| | | |
|---|---|---|
| GB | 2123660 | 2/1984 |
| JP | 2000018589 | 1/2000 |
| JP | 2004093048 | 3/2004 |
| WO | 2012117378 | 9/2012 |

* cited by examiner

EXHAUST CLOSURE SYSTEM FOR A COOKING OVEN

The present invention relates to an exhaust closure system for a cooking oven. Further, the present invention relates to a cooking oven comprising an exhaust closure system.

An exhaust system in a cooking oven reduces humidity resulting by the cooking process. Otherwise humidity would cause condensation in the oven cavity. Different cooking modes generate different amounts of humidity in the oven cavity. Thus, the exhaust system should be adapted to the amount of humidity in order to prevent condensation in the oven cavity.

DE 39 31 483 A1 discloses an exhaust closure system for a cooking oven. A vapour pipe is connected to an upper opening in the oven cavity. In order to provide humidity inside the oven cavity, a flap is arranged in the vapour pipe. The exhaust closure system includes a thermal actuator and a pull-spring. However, the exhaust closure system requires a lot of space and is relative complex.

It is an object of the present invention to provide an exhaust closure system for a cooking oven, which allows a flat construction by low complexity.

The object of the present invention is achieved by the exhaust closure system according to claim 1.

According to the present invention the cover element is a horizontal sheet element and moveable within a horizontal plane for opening and closing the vapour pipe.

The main idea of the present invention is the horizontal flat sheet element covering the vapour pipe, wherein said flat sheet element is movable with the same horizontal plane during opening and closing the vapour pipe. This allows a flat construction of the exhaust closure system. Further, the vapour pipe may be continuously opened and closed, so that different opening widths of the vapour pipe are adjustable.

According to one embodiment of the present invention the cover element is formed as an end portion of the slider and linearly moveable for opening and closing the vapour pipe. In this case the cover element and the slider may be formed as a single-piece part, which allows a construction by low complexity.

According to another embodiment of the present invention the cover element is pivoting around a vertical axis and connected to the slider via a hinged joint.

In this case, the cover element may be a two-armed lever, wherein a first arm is provided for covering the vapour pipe and a second arm is connected to the slider via the hinged joint, and wherein the first arm has at least the double length of the second arm. A small movement of the slider allows a relative big movement of the arm covering the vapour pipe.

Further, the exhaust closure system may comprise at least one guide element for the slider.

In particular, the exhaust closure system is provided for a cooking oven with a horizontal cooling channel in an upper portion of the oven cavity, wherein the cooling channel is arranged above the vapour pipe, and wherein an upper end of the vapour pipe is connected to the cooling channel.

For example, the cover element is arranged inside the cooling channel.

In a similar way, the guide element is arranged inside the cooling channel.

Further, the slider may be partially arranged inside the cooling channel.

In contrast, the driving device may be arranged outside the cooling channel and outside the oven cavity.

For example, the slider and/or the cover element are made of a shape memory alloy.

Moreover, the driving device may be arranged on a top wall of the oven cavity.

Preferably, the driving device is a motor, an actuator or a shape memory alloy.

Further, the present invention relates to a cooking oven with a vertical vapour pipe in an upper portion of the oven cavity, wherein a lower end of the vapour pipe is connected to the oven cavity, wherein the cooking oven includes the exhaust closure system mentioned above.

In particular, the cooking oven includes a horizontal cooling channel in an upper portion of the oven cavity, wherein the cooling channel is arranged above the vapour pipe, and wherein an upper end of the vapour pipe is connected to the cooling channel.

Novel and inventive features of the present invention are set forth in the appended claims.

The present invention will be described in further detail with reference to the drawings, in which FIG. 1 illustrates a perspective view of an exhaust closure system according to a first embodiment of the present invention in an open state, FIG. 2 illustrates a perspective view of the exhaust closure system according to the first embodiment of the present invention in a closed state, FIG. 3 illustrates a perspective view of the exhaust closure system according to the first embodiment of the present invention arranged at a top wall of an oven cavity, FIG. 4 illustrates a perspective view of an exhaust closure system according to a second embodiment of the present invention in the open state, FIG. 5 illustrates a perspective view of the exhaust closure system according to the second embodiment of the present invention in the closed state, FIG. 6 illustrates a perspective view of the exhaust closure system according to the second embodiment of the present invention arranged at the top wall of the oven cavity, FIG. 7 illustrates a detailed sectional side view of the exhaust closure system according to the second embodiment of the present invention, FIG. 8 illustrates a sectional side view of the exhaust closure system according to the second embodiment of the present invention, and FIG. 9 illustrates a further sectional side view of the exhaust closure system according to the second embodiment of the present invention.

FIG. 1 illustrates a perspective view of an exhaust closure system according to a first embodiment of the present invention in an open state The exhaust closure system is provided for opening and closing a vapour pipe 10. A continuous opening and closing of said vapour pipe 10 is provided. The vapour pipe 10 interconnects an oven cavity and a cooling channel. The cooling channel is arranged above the oven cavity.

The exhaust closure system comprises a slider 12, a guide element 14 and a driving device 16. The cooling channel includes a channel wall 18. The slider 12 is arranged inside and outside the cooling channel. The slider 12 penetrates the channel wall 18. The slider 12 is elongated and lamellar. The slider 12 is flat and extends substantially within a horizontal plane. The slider 12 is movable along its longitudinal axis by the driving device 16. The movement of the slider 12 is guided by the guide element 14. The guide element 14 is arranged inside the cooling channel. The driving device 16 is arranged outside the cooling channel. For example, the driving device 16 is a motor, an actuator or a shape memory allow.

An end portion of the slider 12 inside the cooling channel forms a cover element provided for covering the vapour pipe 10. The vapour pipe 10 may be completely or partially covered by said end portion of the slider 12. Further, the vapour pipe 10 may be completely opened, when the slider 12 is moved to the driving device 16 and said end portion of the slider 12 is besides the vapour pipe 10. In FIG. 1 the vapour pipe 10 is almost completely open.

In FIG. 2 the end portion of the slider 12 covers the vapour pipe 10.

Figure 1:
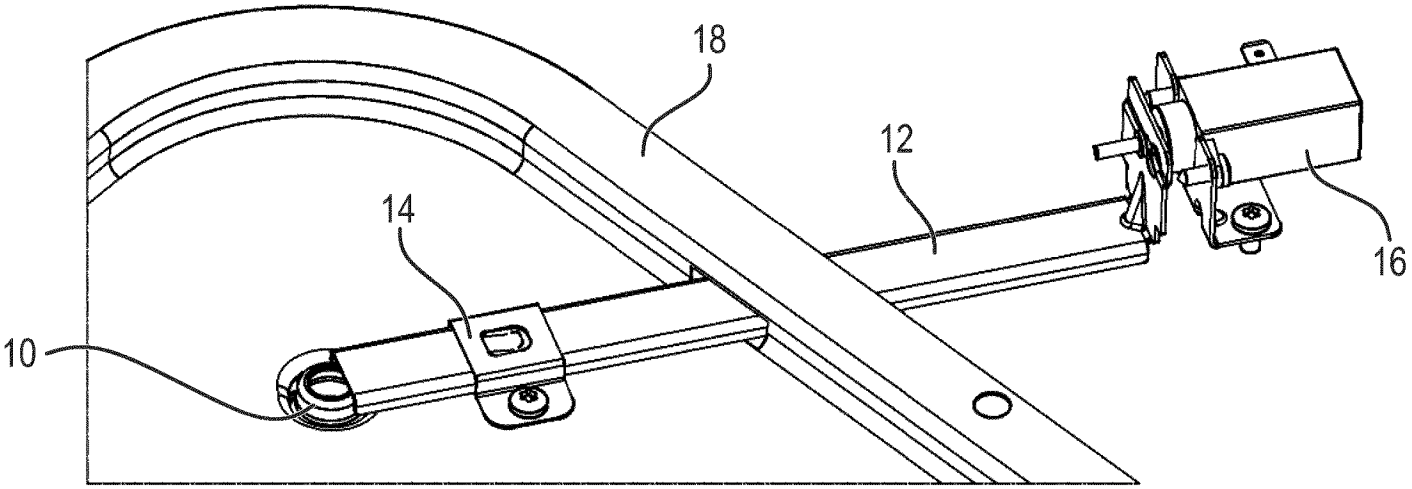
Figure 2:
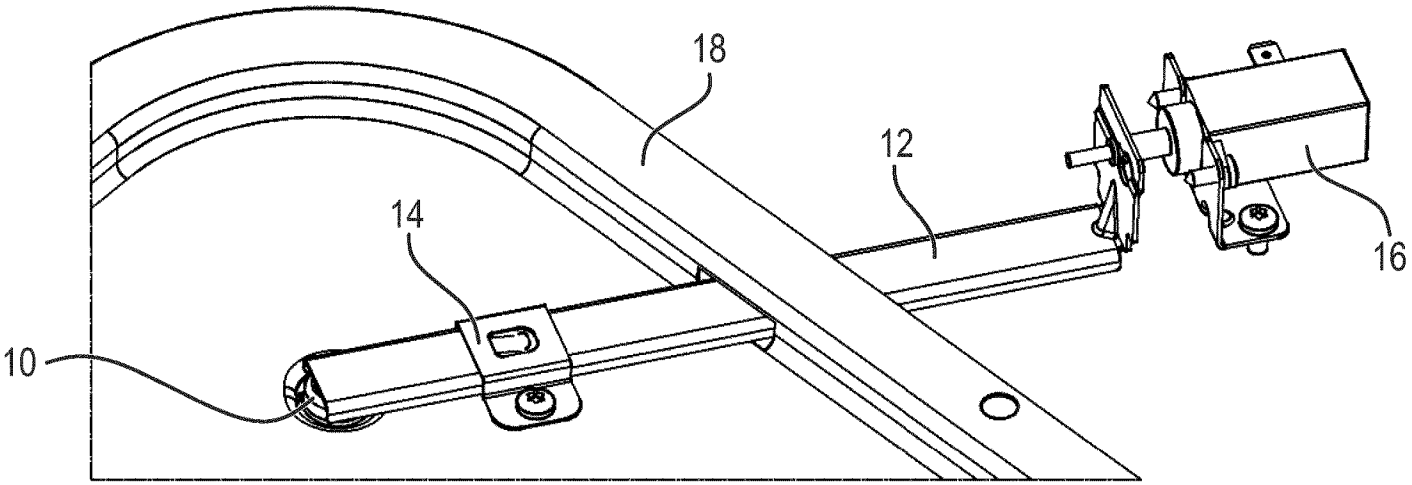
FIG. 2 illustrates a perspective view of the exhaust closure system according to the first embodiment of the present invention in the closed state.
Figure 3:
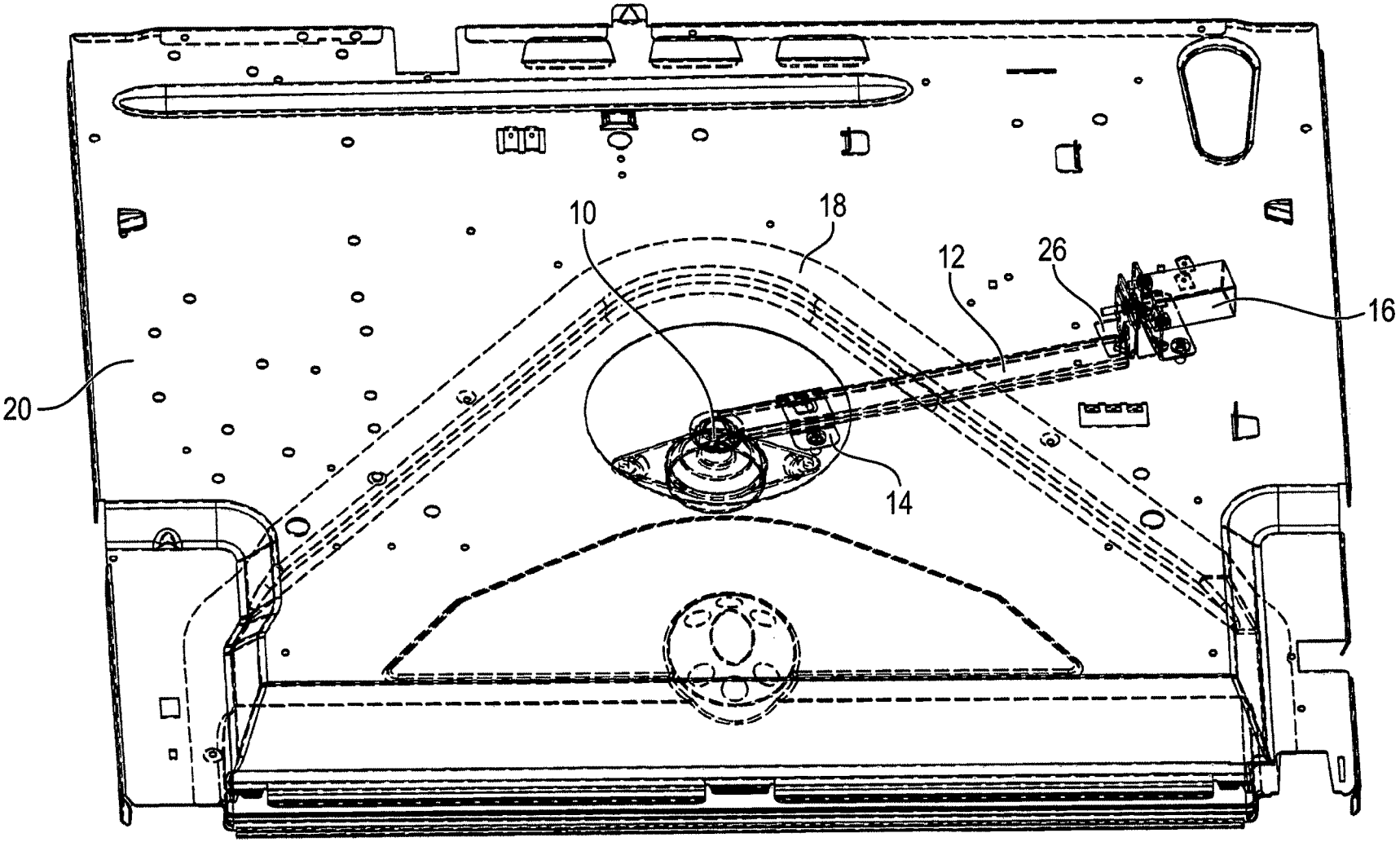
FIG. 3 illustrates a perspective view of the exhaust closure system according to the first embodiment of the present invention arranged at a top wall 20 of an oven cavity.

The channel wall 18 is arranged below the top wall 20 of the oven cavity. Thus, the cooling channel is defined by the space between the channel wall 18 and the top wall 20. The guide element 14 is arranged inside the cooling channel. The driving device 16 is arranged above the top wall 20 of the oven cavity.

In this example, about the one half of the slider 12 is arranged inside the cooling channel, while the other half of said slider 12 is arranged outside the cooling channel. Further, the slider 12 is arranged below the top wall 20 of the oven cavity. The top wall 20 includes a via hole 26 besides the driving device 16. An interconnecting element between the slider 12 and the driving device 16 penetrates through the via hole 26. Said interconnecting element may be a part of the slider 26.

Figure 4:
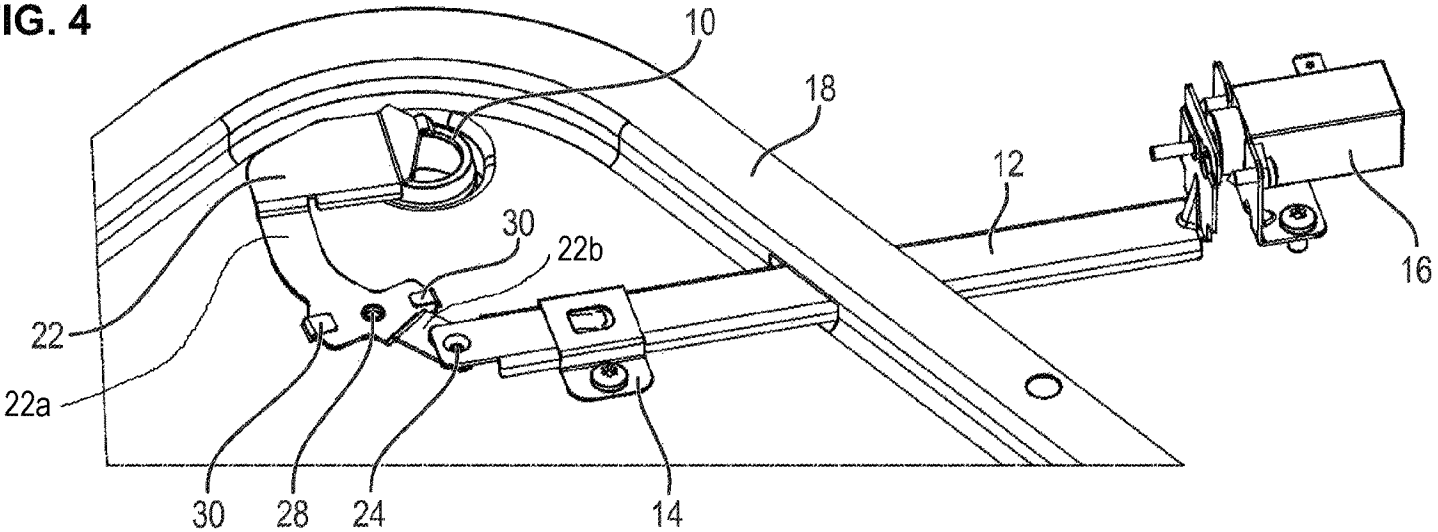

FIG. 4 illustrates a perspective view of an exhaust closure system according to a second embodiment of the present invention in the open state.

The exhaust closure system is provided for opening and closing the vapour pipe 10. The said vapour pipe 10 may be continuously opened and closed. The vapour pipe 10 interconnects the oven cavity and the cooling channel. The cooling channel is arranged above the oven cavity.

The exhaust closure system comprises the slider 12, the guide element 14 and the driving device 16. The cooling channel includes the channel wall 18. The slider 12 is arranged inside and outside the cooling channel. The slider 12 penetrates the channel wall 18. The slider 12 is elongated and lamellar. The slider 12 is movable along its longitudinal axis by the driving device 16. The movement of the slider 12 is guided by the guide element 14. The guide element 14 is arranged inside the cooling channel. The driving device 16 is arranged outside the cooling channel. Preferably, the driving device 16 is a motor, an actuator or a shape memory allow.

The exhaust closure system of the second embodiment comprises a flap 22. The flap 22 forms the cover element for the exhaust closure system of the second embodiment. The flap 22 is substantially formed as a horizontal sheet and pivoting at the channel wall 18 around a swivel 28. The pivoting axis of the flap 22 is vertical. One end of the flap 22 is provided for covering the vapour pipe 10. Another end of the flap 22 is connected to the slider 12 via a hinged joint 24. The flap 22 forms a two-armed lever, wherein a first arm 22*a* is provided for covering the vapour pipe 10 and a second arm 22*b* is connected to the slider 12 via the hinged joint 24. In this example, the first arm 22*a* for covering the vapour pipe 10 has about the double length of the second arm 22*b* connected to the slider 12. Thus, a small movement of the slider 12 causes a relative big motion of the flap 22. Further, a central portion of the flap 22 is guided between two bending ups 30. Said bending ups 30 are pierced in the channel wall 18 and bent up.

Since the flap 22 is substantially formed as the horizontal sheet and the slider 12 is lamellar, the exhaust closure system is very flat. In FIG. 4 the vapour pipe 10 is nearly open.

Figure 5:
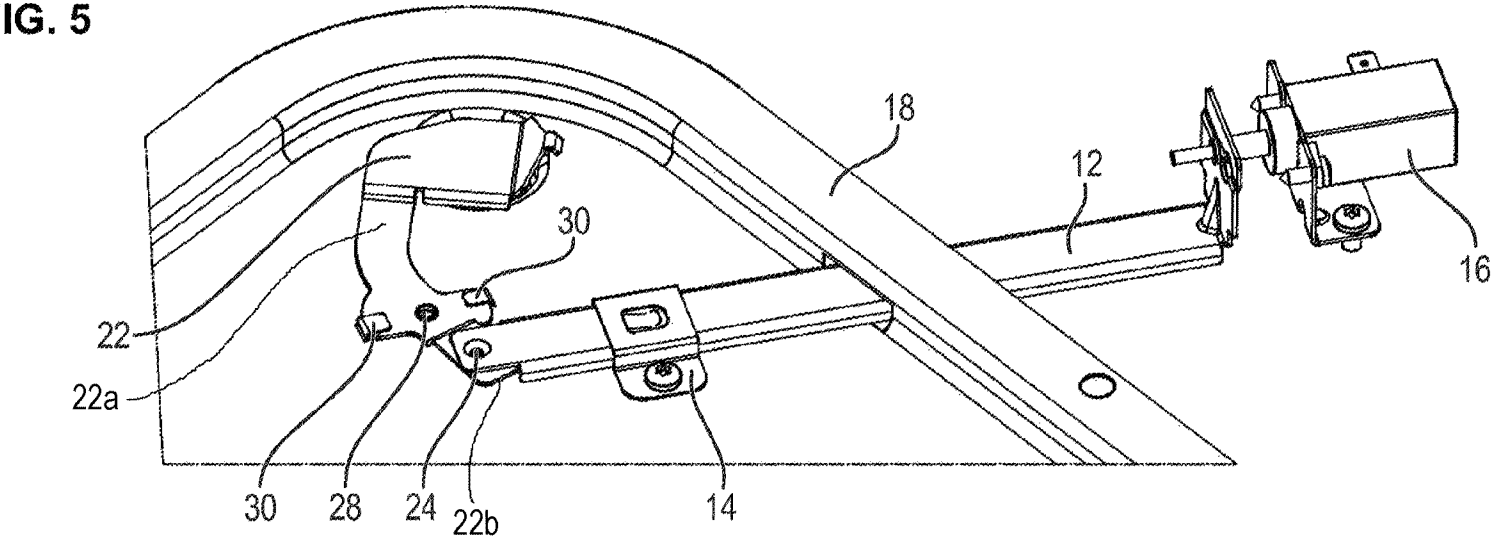

FIG. 5 illustrates a perspective view of the exhaust closure system according to the second embodiment of the present invention in the closed state. In FIG. 5 the flap 22 covers the vapour pipe 10.

Figure 6:
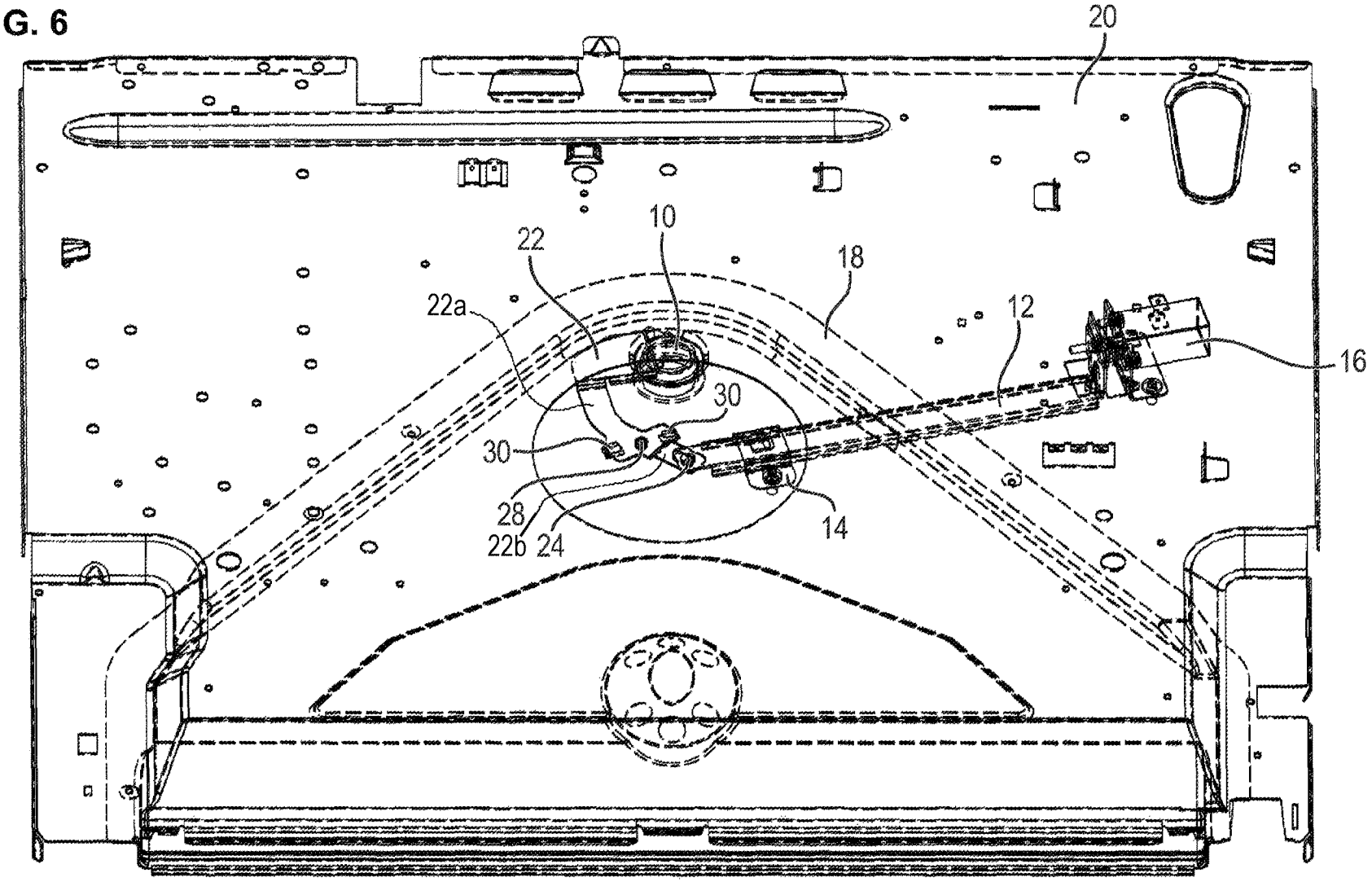

FIG. 6 illustrates a perspective view of the exhaust closure system according to the second embodiment of the present invention arranged at the top wall 20 of the oven cavity.

The channel wall 18 is arranged below the top wall 20 of the oven cavity, so that the cooling channel is defined by the space between the channel wall 18 and the top wall 20. The guide element 14 is arranged inside the cooling channel. The driving device 16 is arranged above the top wall 20 of the oven cavity. In this example, about the one half of the slider 12 is arranged inside the cooling channel, while the other half of said slider 12 is arranged outside the cooling channel. Further, the slider 12 is arranged below the top wall 20 of the oven cavity. The top wall 20 includes a via hole 26 besides the driving device 16. An interconnecting element between the slider 12 and the driving device 16 penetrates through the via hole 26. Said interconnecting element may be a part of the slider 26. The flap 22 is also arranged inside the cooling channel.

Figure 7:
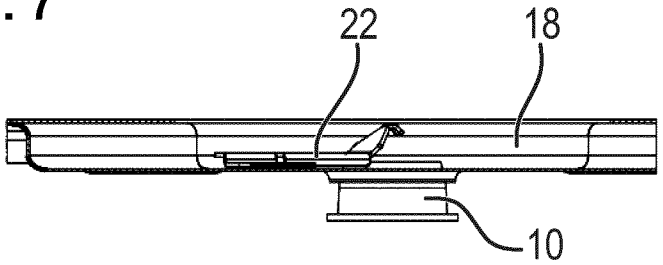

FIG. 7 illustrates a detailed sectional side view of the exhaust closure system according to the second embodiment of the present invention. FIG. 7 clarifies the flat structure of the flap 22.

Figure 8:
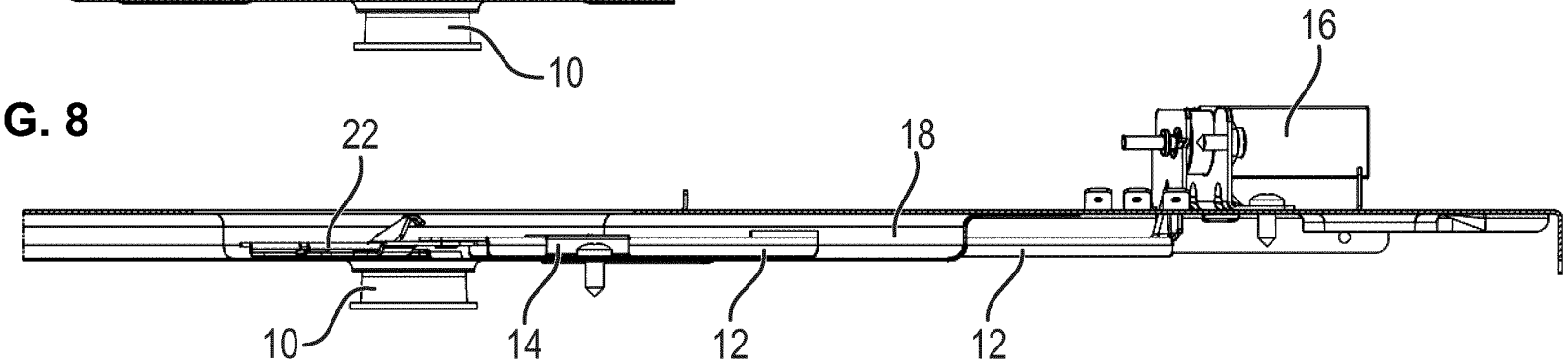

FIG. 8 illustrates a sectional side view of the exhaust closure system according to the second embodiment of the present invention.

Figure 9:
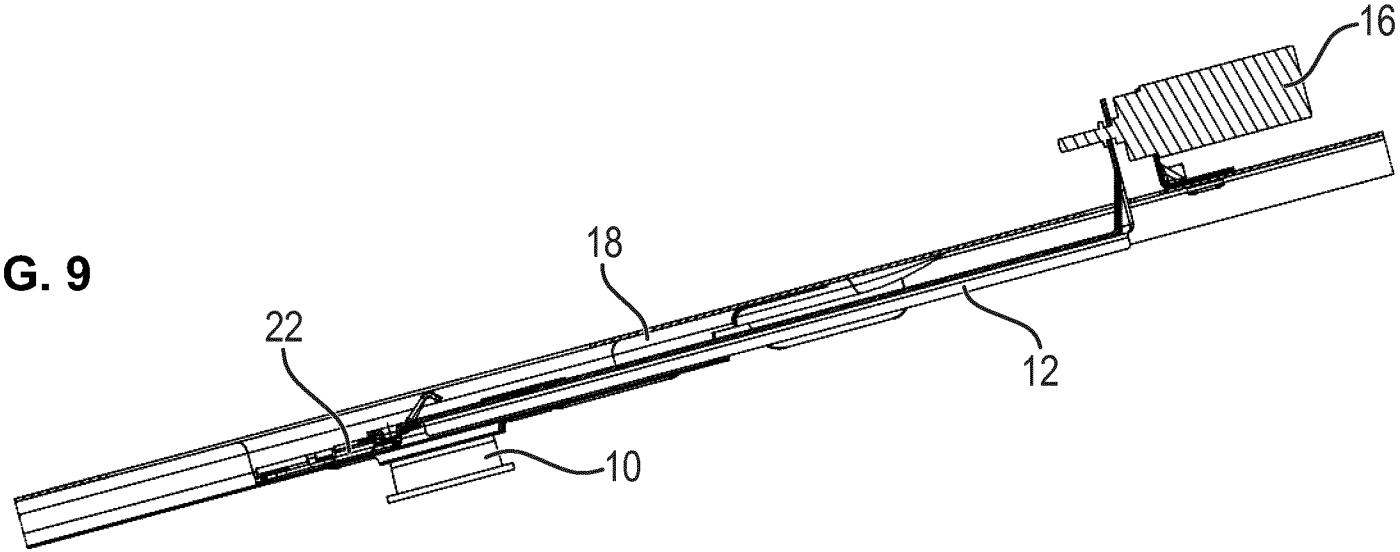

FIG. 9 illustrates a further sectional side view of the exhaust closure system according to the second embodiment of the present invention. FIG. 8 and FIG. 9 clarify the flat structure of the flap 22, the slider 12 and the cooling channel.

In the exhaust closure system of the second embodiment a relative small motion of the slider 12 is sufficient for opening and closing the vapour pipe 10.

Although two illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 vapour pipe
12 slider
14 guide element
16 driving device
18 channel wall
20 top wall
22 flap
24 hinged joint
26 via hole
28 swivel
30 bending up

The invention claimed is:

1. A cooking oven with a vertical vapor pipe in an upper portion of the oven cavity, wherein a lower end of the vapor pipe is connected to the oven cavity, the cooking oven includes an exhaust closure system, the exhaust closure system comprises an elongated slider extending over the oven cavity and linearly movable along its longitudinal axis in a generally horizontal direction, at least one guide element for the slider and a driving device for moving the slider, the exhaust closure system comprises a cover element for covering the vapor pipe, and the cover element is a horizontal sheet element moveable in a generally horizontal direction for opening and closing the vapor pipe.

2. The cooking oven according to claim 1, wherein the cover element is formed as an end portion of the slider and is linearly moveable for opening and closing the vapor pipe.

3. The cooking oven according to claim 1, wherein the cover element is a flap that pivots around a vertical axis and is connected to the slider via a hinged joint.

4. The cooking oven according to claim 3, wherein the flap is a two-armed lever, wherein a first arm is provided for covering the vapor pipe and a second arm is connected to the slider via the hinged joint, and wherein the first arm has at least the double length of the second arm.

5. The cooking oven according to claim 1, wherein the cooking oven includes a horizontal cooling channel in an upper portion of the oven cavity, wherein the cooling channel is arranged above the vapor pipe, and wherein an upper end of the vapor pipe is connected to said cooling channel.

6. The cooking oven according to claim 5, wherein the cover element is arranged inside the cooling channel.

7. The cooking oven according to claim 5, wherein the guide element is arranged inside the cooling channel.

8. The cooking oven according to claim 5, wherein the slider is partially arranged inside the cooling channel.

9. The cooking oven according to claim 5, wherein the driving device is arranged outside the cooling channel and outside the oven cavity.

10. The cooking oven according to claim 1, wherein the slider and/or the cover element are made of a shape memory alloy.

11. The cooking oven according to claim 1, wherein the driving device is arranged on a top wall of the oven cavity.

12. The cooking oven according to claim 2, wherein the end portion is selectively positioned over an open upper end of the vapor pipe for opening and closing the vapor pipe.

13. The cooking oven according to claim 3, wherein a longitudinal axis of the slider is disposed at an obtuse angle relative to a wall of a cooling channel traversed by the slider as the driving device moves the slider along its longitudinal axis.

14. The cooking oven according to claim 1, wherein the driving device comprises a motor, an actuator or a shape memory alloy.

* * * * *